United States Patent [19]

Kress et al.

[11] Patent Number: 4,729,710

[45] Date of Patent: Mar. 8, 1988

[54] LADLE CARRIER WITH LATERALLY SHIFTABLE CRADLE

[75] Inventors: Edward S. Kress; Dennis R. Thomas; William L. LaBerdia, all of Brimfield, Ill.

[73] Assignee: Kress Corporation, Brimfield, Ill.

[21] Appl. No.: 9,688

[22] Filed: Feb. 2, 1987

[51] Int. Cl.[4] ..... B65G 65/04

[52] U.S. Cl. ..... 414/421; 414/420; 414/460

[58] Field of Search ..... 414/419–425, 414/354, 403, 458, 460, 461, 471, 639, 713, 678, 679, 495, 498; 298/11

[56] References Cited

U.S. PATENT DOCUMENTS

| | | | |
|---|---|---|---|
| 3,330,429 | 7/1967 | Kress | 414/421 |
| 3,825,135 | 7/1974 | Kress | 414/420 |
| 3,863,791 | 2/1975 | Brock | 414/421 |
| 3,897,881 | 8/1975 | Brock | 414/424 |
| 4,009,790 | 3/1977 | Brock | 414/420 X |
| 4,027,808 | 6/1977 | Hardwick | 414/420 |
| 4,063,658 | 12/1977 | Kress | 414/421 |
| 4,105,130 | 8/1978 | Hardwick et al. | 414/421 |
| 4,122,961 | 10/1978 | Kress | 414/421 |

*Primary Examiner*—Robert J. Spar
*Assistant Examiner*—Vien Nguyen
*Attorney, Agent, or Firm*—Leydig, Voit & Mayer

[57] ABSTRACT

A carrier for lifting and transporting a heavy ladle including a tractor and a trailer having a longitudinal center line and a U-shaped frame and a rearwardly opening cradle pivotally mounted on the frame for embracing the ladle and with hooks suspended from the cradle for engaging and lifting the ladle by its trunnions provided with a hydraulic lift cylinder for vertically pivoting the cradle with respect to the trailer frame and wherein the cradle legs have extension members hinged thereto and are interconnected by a hydraulic swing actuator for selectively swinging the legs and extension members about the hinges so as to shift the cradle and hooks laterally with respect to the trailer center line. In the preferred embodiment the cradle and the hydraulic lift cylinder are pivotally connected to the trailer frame with ball connections to permit limited lateral tilting thereof and the cradle is essentially self-centering with respect to the trailer center line when the pressure in the hydraulic swing actuator is relieved.

8 Claims, 5 Drawing Figures

LADLE CARRIER WITH LATERALLY SHIFTABLE CRADLE

FIELD OF THE INVENTION

The present invention relates generally to a heavy duty vehicle and more particularly concerns a carrier trailer for picking up and transporting ladles or slag pots of the kind used in the steel-making industry.

BACKGROUND OF THE INVENTION

In U.S. Pat. Nos. 3,330,429; 3,825,135; 4,063,658 and 4,122,961 there are disclosed various forms of heavy duty carriers intended to pick up, transport and dump large ladles or slag pots of the kind used in foundries, steel mills and other metal and slag generating industries. The larger ones of such pots and ladles, when loaded, often weigh on the order of 200 to 400 tons. Slag pots are typically made of very heavy-walled rugged construction and can take considerable knocking, pounding, dropping and other abuse in normal handling operations. Ladles for transporting molten metal, on the other hand, are usually made with relatively thin-walled metal shells lined with refractory material which is quite fragile in nature and can be easily damaged if the ladle is bumped or jarred while being picked up, carried or set down.

Generally speaking, the carriers disclosed in the above patents include a trailer with a pair of heavy trailing arms on which the load supporting wheels are mounted and a generally U-shaped rigid cradle pivotally mounted on the trailer arms for embracing the pot or ladle and supporting it through large laterally spaced hooks suspended from the cradle side arms to engage the pot or ladle trunnions. The suspension hooks are usually spaced just wide enough apart to clear the sides of the pot or ladle when the trailer is backed into the lift position, thus requiring very accurate maneuvering of the large, heavy trailer lest the pot or ladle be unnecessarily bumped or jarred. Likewise, the trailer must be very carefully steered and positioned to place the pot or ladle in the proper location or stand before it is lowered onto its support.

OBJECTS AND SUMMARY OF THE INVENTION

It is the primary aim of the present invention to provide a heavy duty carrier for pots, ladles and the like with a supporting cradle and suspension hooks that can be moved laterally relative to the trailer in order to facilitate proper alignment with the ladle for pickup and to laterally adjust the ladle position relative to the trailer when the ladle is being set down.

A further object of the invention is to provide a heavy ladle supporting cradle with laterally articulated arms and an actuating mechanism for adjusting the cradle and suspension hooks relative to the trailer center line. It is a more specific object to provide such a laterally adjustable supporting cradle that tends to be self-centering when the actuating mechanism is deactivated.

Yet another object of the invention is to provide a ladle carrier of the above type with rigid carry arms for supporting the ladle during transport and a stabilizer for limiting the fore and aft swing of the ladle during transport.

According to the present invention, a carrier for lifting and transporting a heavy ladle is provided including a tractor and a trailer having a longitudinal center line and a U-shaped frame and a rearwardly opening cradle pivotally mounted on the frame for embracing the ladle and with hooks suspended from the cradle for engaging and lifting the ladle by its trunnions. A hydraulic lift cylinder is provided for vertically pivoting the cradle with respect to the trailer frame and the cradle legs are provided with extension members hinged thereto and interconnected by a hydraulic swing actuator for selectively swinging the legs and extension members about the hinges so as to shift the cradle and hooks laterally with respect to the trailer center line. In the preferred embodiment, the cradle and the hydraulic lift cylinder are pivotally connected to the trailer frame with ball connections to permit limited lateral tilting thereof and the cradle is essentially self-centering with respect to the trailer center line when the pressure in the hydraulic swing actuator is relieved.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENTS

Figure 1:
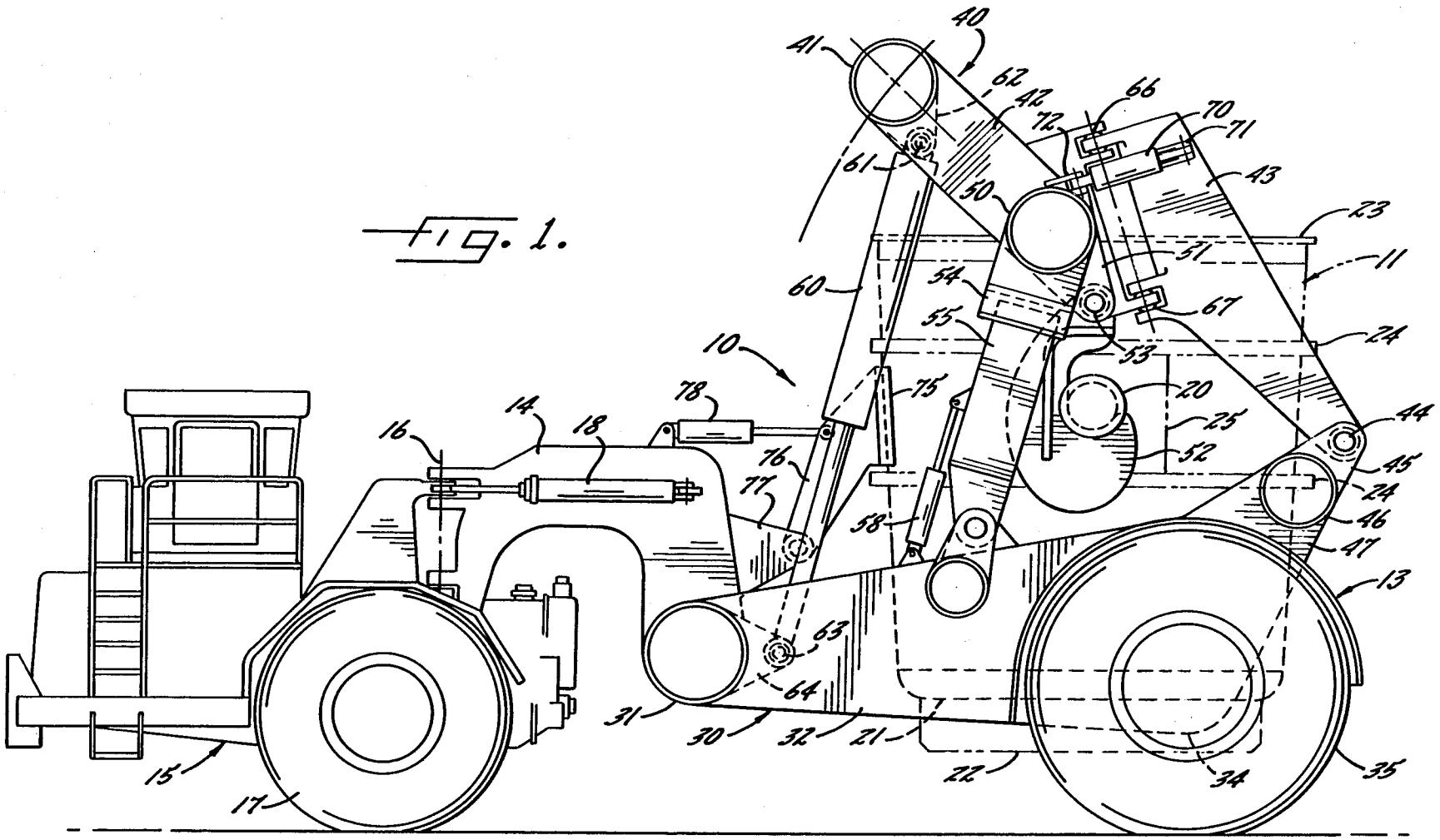
FIG. 1 is a side elevation of the ladle carrier of the present invention with the ladle shown raised to the transport position.
Figure 2:
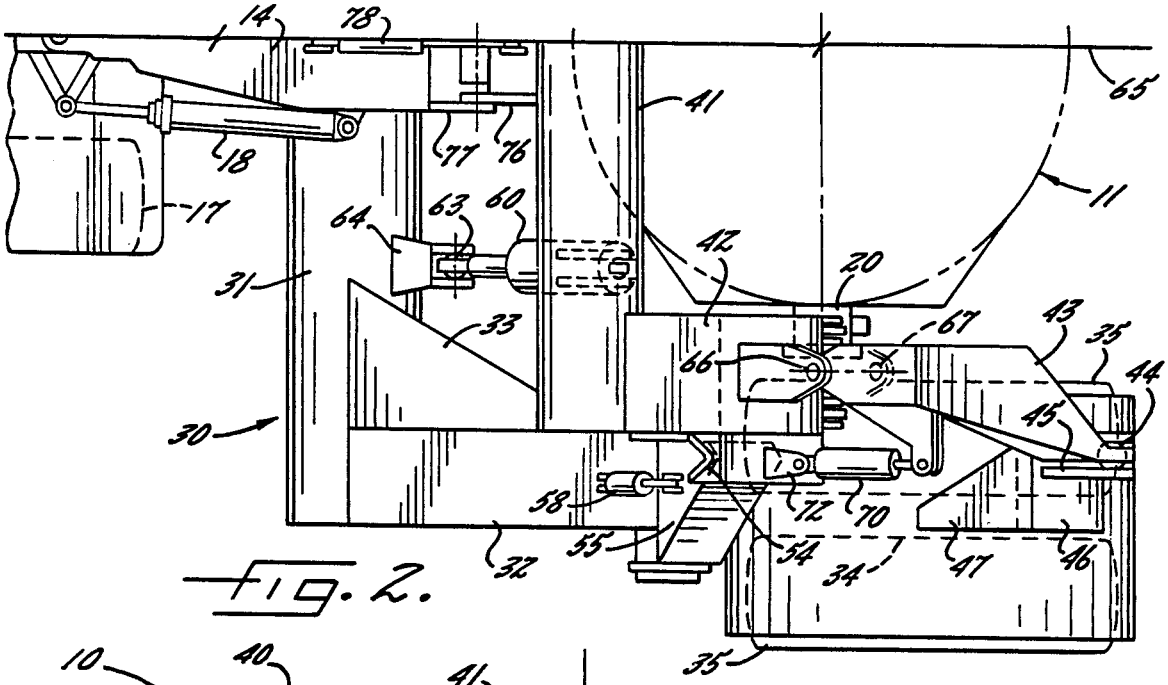
FIG. 2 is a fragmentary top plan view of the carrier of FIG. 1.
Figure 3:
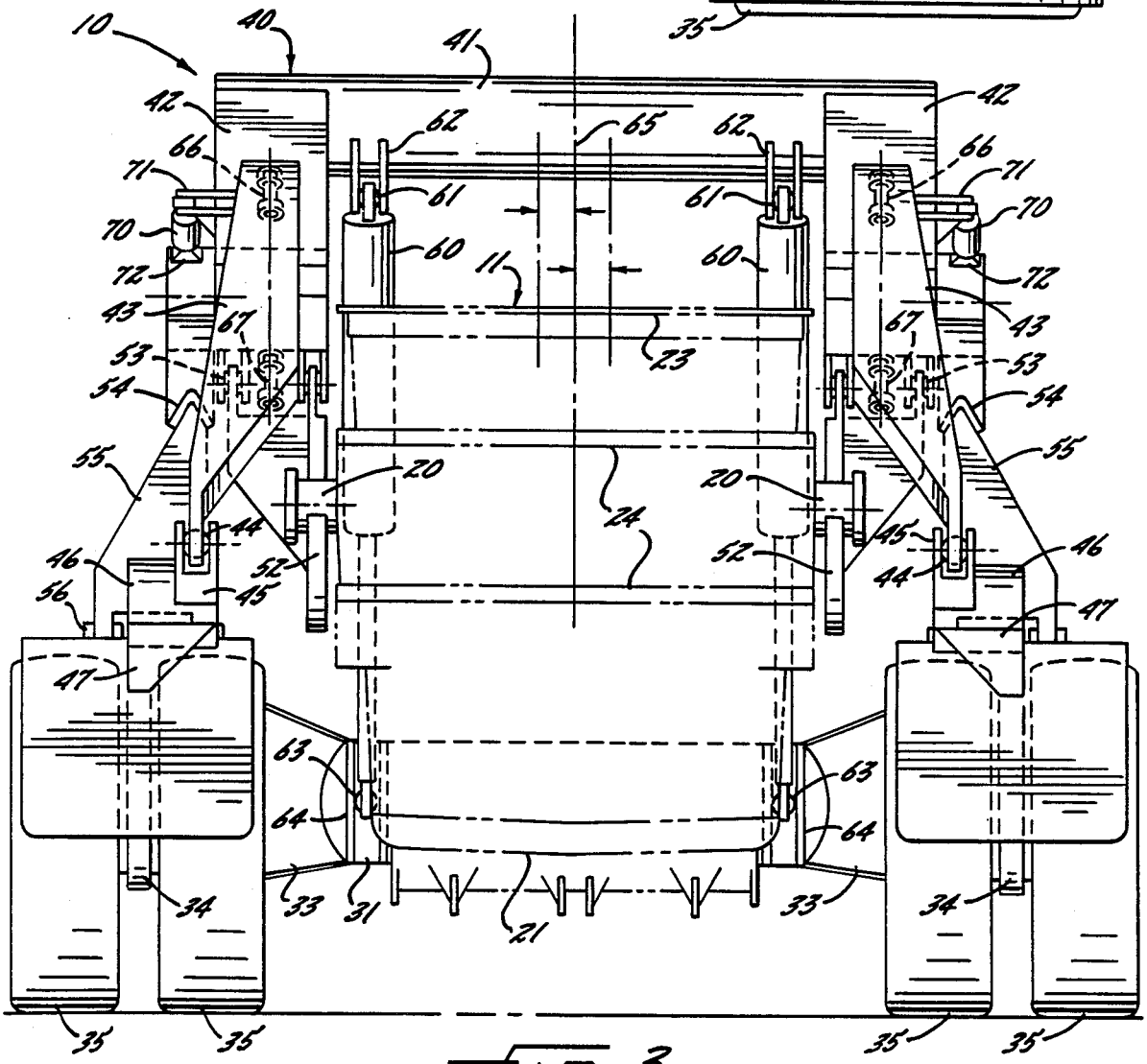
FIG. 3 is a rear elevation of the carrier of FIG. 1.

Turning now to the drawings, there is shown in FIG. 1 a heavy duty carrier 10 for lifting and transporting a ladle 11 or the like. The carrier 10 includes a trailer 13 with a forwardly projecting gooseneck-like member 14 connected to a suitable prime mover such as a two-wheeled tractor 15. The trailer 13 and tractor 15 are pivoted about a vertical axis 16 that passes close to the axis of the tractor ground wheels 17. A pair of steering actuators 18 interconnect the tractor and trailer 13 for pivoting the assembly about the vertical axis 16 to give extremely good maneuverability. The gooseneck-like member 14 provides sufficient clearance over the tractor wheels 17 so that the tractor can be turned substantially at right angles to the trailer and the carrier can turn substantially within its own length.

The ladle 11 (slag pot or other container) is typically cup-shaped and is formed with side projections 20 in the form of trunnions for lifting and dumping the ladle 11. The ladle may be formed with a reduced diameter base portion 21 adapted to fit into a ladle stand (not shown) and has a flat bottom 22. Typically, the ladle 11 includes a reinforced upper lip 23 and may also include one or more circumferential reinforcing flanges 24 and reinforcing plates 25 in the area of the trunnions 20.

The trailer 13 includes a generally U-shaped main frame 30 including a heavy tubular cross beam 31 integral with the gooseneck 14 and a pair of rearwardly projecting, heavy box-like side members 32 rigidly joined to the cross beam 31 and reinforced there with triangular plates 33. The rear ends 34 of the side members 32 are formed with narrower widths and deeper vertical sections for supporting axle means (not shown) for journalling a plurality of trailer wheels 35. In the preferred embodiment, dual wheels 35 are provided at the rear end 34 of each side member 32. It will be understood that the wheels 35 are of the heavy duty type and each may have a load bearing capacity of 100 tons or more.

For lifting and carrying the ladle 11, a generally U-shaped cradle 40 is provided which is dimensioned to embrace the ladle on three sides. The cradle 40 is a composite structure including a rigid forward portion with a heavy tubular cross frame 41 and a pair of rearwardly projecting box-like leg members 42 rigidly joined to the cross frame 41. The cradle 40 also includes a pair of heavy duty leg extensions 43 hingedly mounted on the rear ends of the respective leg members 42 and pivoted at their trailing ends through ball connections 44 to bifurcated mounting ears 45 projecting upwardly from short tubular subframes 46 rigidly connected by reinforcing plates 47 to the rear ends 34 of the trailer side members 32.

A short heavy duty lift tube 50 is rigidly secured at the end of each box-like cradle leg 42. Each tube 50 carries a plurality of laterally spaced hook mounting ears 51 from which a reinforced hook 52 is suspended by a cross shaft 53. Also rigidly attached to each lift tube 50 is a downwardly depending inverted V-shaped support shoulder 54 for receiving the upper end of a carrying arm 55 pivotally connected to upstanding mounting ears 56 rigidly affixed through a reinforcing tube 57 to the trailer side members 32. A small hydraulic actuator 58 is connected between the side member 32 and the carrying arm 55 for pivoting the arm 55 from the inactive position shown in FIG. 4 to the active support position shown in FIG. 1.

Figure 4:
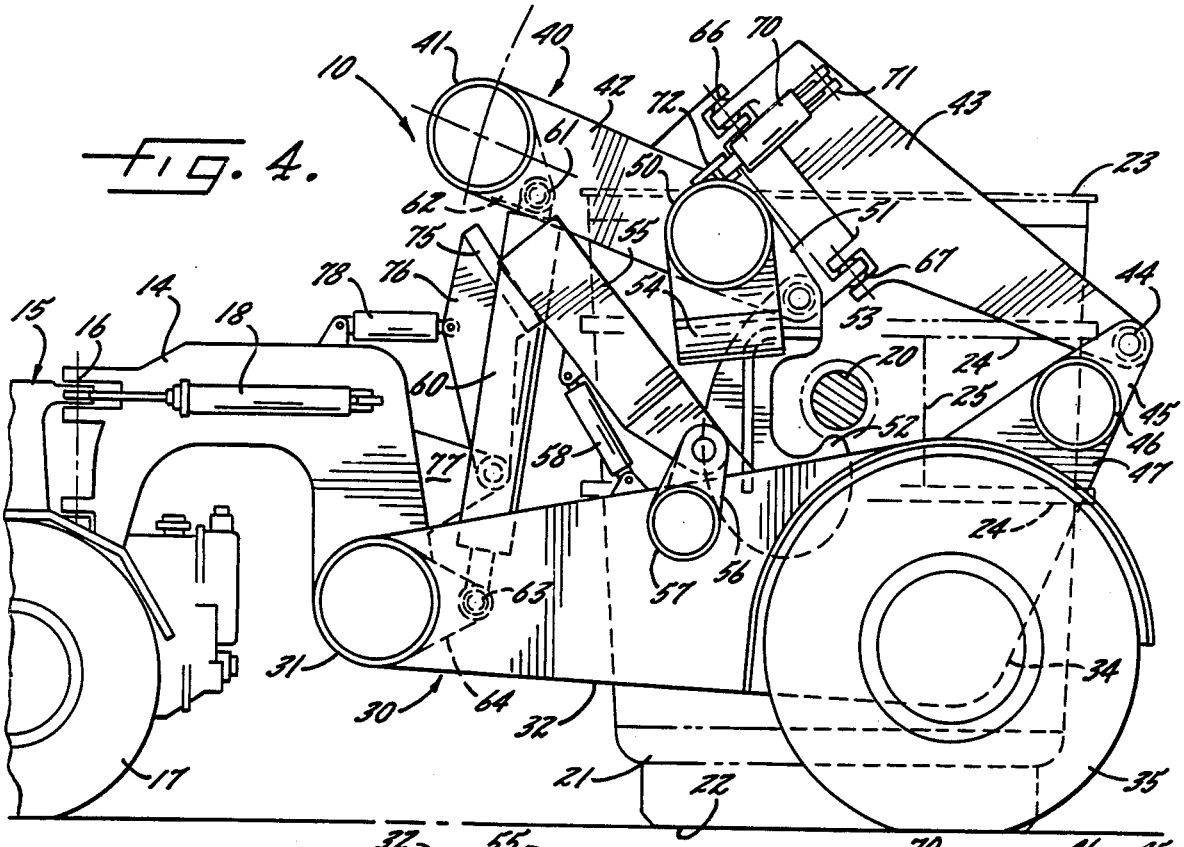
FIG. 4 is a fragmentary side elevation of the ladle carrier of FIG. 1 with the ladle shown in dash lines in the pick up or set down position; and, FIG. 5 is a fragmentary top plan view of the carrier of FIG. 1 with the ladle and ladle cradle moved laterally away from the carrier center line.

Referring to FIG. 4, the ladle 11 is shown in dash lines sitting on the ground and the hook 52 is just clear of the ladle trunnion 20. If the trailer 13 is backed up by the tractor 15, the hook 52 will be centered under the trunnion 20 and the ladle can be picked up by pivoting the cradle upwardly on the ball connections 44. Conversely, if the tractor 15 is pulled ahead, the trailer 13 and cradle 40 can be completely separated from the ladle.

To pivot the cradle 40 upward and thus raise the ladle 11, a pair of heavy duty lift cylinders 60 are provided. In the preferred embodiment, the upper end of each cylinder 60 is pivotally connected through a ball connection 61 to a pair of mounting lugs 62 rigidly secured to the cross frame 41 of the cradle 40. The lower or piston rod end of each cylinder 60 is likewise pivotally connected through a ball connection 63 to a bifurcated mounting bracket 64 rigidly attached to the trailer cross beam 31. It will be understood that as the hydraulic cylinders 60 are extended the cradle 40 is pivoted upwardly to lift the ladle 11 and as the cylinders are retracted the ladle is lowered.

Figure 5:
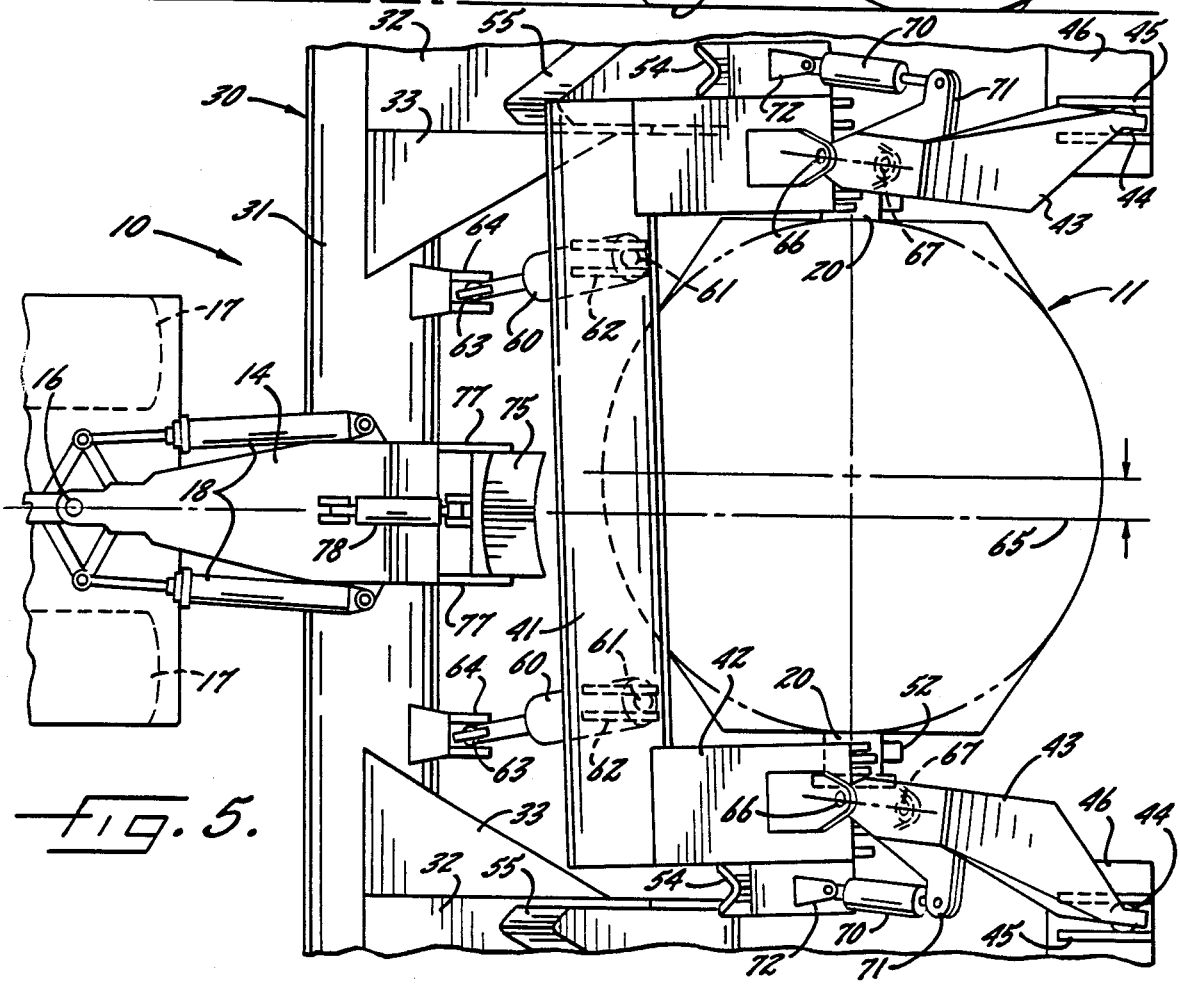

In accordance with the present invention, means are provided for laterally shifting the cradle 40 with respect to the longitudinal center line 65 of the trailer 13. To this end, each of the extensions 43 is hinged to each of the cradle legs 42 by spaced apart hinge connections 66 and 67 and a double acting hydraulic actuator 70 is connected between a laterally projecting arm 71 on the extension 43 and a mounting bracket 72 secured to the lift tube 50. As shown in FIG. 5 when the left side actuator 70 is retracted and the right side actuator 70 is extended, the cradle 40 is shifted laterally to the right of the trailer center line 65. The converse is also true and preferably the dimensions are such that the cradle 40 and depending hooks 50 can be shifted laterally about 12 inches to either side of the trailer center line 65.

Pursuant to the invention, the main hydraulic lift actuators 60 act as front legs for the cradle 40 and the extensions 43 act as rear legs. By virtue of the ball connections 44 at the rear ends of the extensions 43 and the ball connections 61, 63 at the ends of the lift cylinders 60, the rigid portion of the cradle 40, including the cross frame 41 and legs 42, is shifted laterally as a unit upon appropriate energization of the shift actuators 70. Also while two shift actuators 70 are shown in the illustrated embodiment, it should be understood that the geometry is such that lateral shifting can be accomplished with only a single actuator 70, if desired.

It will also be appreciated that by laterally shifting the cradle 40, the hooks 52 can be easily brought into proper alignment with the trunnions 20 as the trailer 13 is backed into position around the ladle 11. This means that maneuvering the tractor 15 and trailer 13 is less critical and also the chances of bumping, jarring and damaging the ladle are consequently lessened. Likewise, when the ladle 11 is to be set down it can be accurately located laterally with respect to a companion ladle stand or other designated support by appropriately energizing the shift actuators 70. Again, this makes it substantially easier to accurately spot the ladle 11 without requiring great driver skill or repeatedly maneuvering the tractor 15 and trailer 13.

It is another feature of the present invention that the cradle 40 is essentially self-centering with respect to the trailer center line 65 when the pressure in the shift actuators 70 is relieved. Due to the orientation of the hinge connections 66, 67 of the cradle extension members 43, the cradle 40 tends to naturally swing by gravity to its centered position with the cradle legs 41 and extension members 43 in longitudinal alignment. This is true not only when the cradle 40 is empty but more importantly, when the ladle 11 is suspended from the hooks 52.

During transport of a ladle 11, it is desirable to take the load off the main lift cylinders 60. Therefore, after the ladle 11 is picked up by the hooks 52, the small hydraulic actuators 58 are extended to pivot the carry arms 55 from the positions shown in FIG. 4 to the transport position shown in FIG. 1. The main lift cylinders are then retracted slightly so that the inverted V-shaped support shoulders 54 rest firmly and securely on the upper ends of the support arms 55.

It is also desirable to prevent the ladle 11 from swinging fore and aft during transport as this causes undesirable weight shifting of heavy ladle loads and consequent surging motion of the tractor-trailer combination. Accordingly, a ladle swing damper is provided in the form of an arcuate abutment plate 75 pivotally mounted through a pair of support legs 76 to mounting ears 77 rigidly secured to the trailer gooseneck 14. A hydraulic actuator 78 also interconnects the support legs 76 and the gooseneck 14 for swinging the abutment plate 75 firmly against the ladle 11 to thereby resist fore and aft swinging movement of the ladle 11 in the cradle 40 and also to prevent the ladle 11 from pivoting about its trunnions 20.

From the foregoing, it will be appreciated that the present invention provides a novel heavy duty ladle carrier 10 having an articulated ladle support cradle 40 that may be easily shifted laterally to align the suspended support hooks 52 with the ladle trunnions 20 for pick up or for aligning the ladle 11 over a support stand or the like for accurate ladle set down. Due to the novel arrangement of the hinge points 66, 67 on the cradle legs 42 and extensions 43 and the ball connections 44, 61 and 63 the cradle 40 and hooks 52 tend to be self-centering with respect to the trailer center line 65 when the pressure in the shift actuators 70 is relieved.

We claim as our invention:

1. A carrier for lifting and transporting a heavy ladle or the like having lateral trunnions, comprising in combination, a self-propelled tractor and a wheeled trailer having a longitudinal center line and a generally U-shaped frame with rearwardly projecting side members, and a forwardly projecting integral gooseneck pivotally connected to the tractor to permit turning thereof at substantially right angles, a generally rearwardly opening cradle connected by pivot means adjacent the rear ends of the trailer side members and adapted to embrace the ladle, hook means suspended from the cradle for engaging the ladle trunnions and lifting the ladle, a hydraulic lift actuator interconnected by pivot means to the forward portion of the cradle and the forward portion of the trailer frame for pivotally raising and lowering the cradle with respect to the trailer side members, said cradle including a generally U-shaped forward portion with rearwardly extending legs and a pair of rear extension members respectively connected by hinge means adjacent the ends of the legs, and actuator means interconnecting the legs and extension members for selectively swinging the legs and extension members about the hinge means so as to shift the cradle and hooks laterally with respect to the trailer center line.

2. A carrier as defined in claim 1 wherein said cradle pivot means and said lift actuator pivot means include ball-like connections to permit limited lateral tilting thereof.

3. A carrier as defined in claim 2 wherein said hinge means and said pivot means are disposed such that said cradle and hooks are essentially self-centering with respect to the trailer center line when the pressure in said hydraulic shift actuator is relieved.

4. A carrier as defined in claim 1 wherein said U-shaped forward portion of the cradle includes a heavy tubular cross frame and a pair of rigid box-like leg members and a short heavy duty lift tube is rigidly secured at the end of each leg member for supporting said hook means.

5. A carrier as defined in claim 4 including a supporting shoulder rigidly mounted on the underside of said lift tube and a supporting arm pivotally mounted on the trailer side member for swinging into engagement with said shoulder during transport of the ladle in the carrier.

6. A carrier as defined in claim 5 including a hydraulic actuator for selectively swinging said support arm into and out of engagement with said supporting shoulder.

7. A carrier as defined in claim 1 including abutment means selectively engageable with the ladle to prevent it from swinging fore and aft and from rotating about its trunnions during transport.

8. A carrier as defined in claim 7 including a hydraulic actuator for swinging said abutment means into and out of engagement with the ladle.

* * * * *